US008517086B2

(12) United States Patent
Mathew et al.

(10) Patent No.: US 8,517,086 B2
(45) Date of Patent: Aug. 27, 2013

(54) COMPOSITE HEAT EXCHANGER END STRUCTURE

(75) Inventors: Sunil I. Mathew, Peoria, IL (US); Dan J. Becker, Peoria, IL (US); Thomas J. Grabenstetter, Metamora, IL (US); Daniel A. Piterski, Conover, NC (US); William E. Donovan, Newton, NC (US); Stephen M. Bertrand, Stony Point, NC (US)

(73) Assignee: Caterpillar Inc., Peoria, IL (US)

( * ) Notice: Subject to any disclaimer, the term of this patent is extended or adjusted under 35 U.S.C. 154(b) by 563 days.

(21) Appl. No.: 12/370,744

(22) Filed: Feb. 13, 2009

(65) Prior Publication Data

US 2009/0218081 A1 Sep. 3, 2009

Related U.S. Application Data

(60) Provisional application No. 61/032,799, filed on Feb. 29, 2008.

(51) Int. Cl.
*F28F 9/02* (2006.01)
*F28D 7/10* (2006.01)

(52) U.S. Cl.
USPC ..... 165/158; 165/173

(58) Field of Classification Search
CPC ..... F28F 9/0219; F28F 9/0224; F28F 9/0226
USPC ..... 165/158, 159, 161, 173, 75; 422/46
See application file for complete search history.

(56) References Cited

U.S. PATENT DOCUMENTS

| | | | | |
|---|---|---|---|---|
| 2,240,537 | A * | 5/1941 | Young | 165/83 |
| 3,351,131 | A | 11/1967 | Berthold | |
| 3,656,548 | A | 4/1972 | Donaldson | |
| 3,907,030 | A | 9/1975 | Moss et al. | |
| 3,958,630 | A | 5/1976 | Smith | |
| 4,016,929 | A | 4/1977 | Pfluger et al. | |
| 4,026,565 | A | 5/1977 | Jelinek | |
| 4,323,115 | A * | 4/1982 | Stafford et al. | 165/79 |
| 4,421,160 | A * | 12/1983 | Stafford et al. | 165/76 |
| 4,475,588 | A * | 10/1984 | Tsou | 165/159 |
| 5,036,912 | A * | 8/1991 | Woosnam | 165/158 |
| 5,048,596 | A | 9/1991 | Lu | |
| 5,058,661 | A * | 10/1991 | Oshiyama | 165/70 |
| 5,192,499 | A * | 3/1993 | Sakai et al. | 422/46 |
| 5,251,693 | A | 10/1993 | Zifferer | |
| 5,718,871 | A * | 2/1998 | Elgas | 422/46 |
| 6,810,837 | B2 | 11/2004 | Lazarus et al. | |
| 6,840,306 | B2 | 1/2005 | Mota et al. | |

(Continued)

FOREIGN PATENT DOCUMENTS

| | | |
|---|---|---|
| GB | 2213922 | 8/1989 |
| JP | 59137787 | 8/1984 |
| KR | 1020070078936 | 8/2007 |
| SU | 848950 | 7/1981 |

*Primary Examiner* — Tho V Duong

(74) *Attorney, Agent, or Firm* — Finnegan, Henderson, Farabow, Garrett & Dunner LLP

(57) ABSTRACT

A heat exchanger having a tube bundle disposed within a housing with a resilient end structure disposed in compressed, plug-forming relation at least partially across the heat exchanging cavity. The resilient end structure includes one or more boundary segments extending between an internal wall of the housing and the perimeter of the tube bundle. The boundary segment includes a combination of materials having differing compression characteristics providing enhanced support to the boundary segments.

21 Claims, 5 Drawing Sheets

(56) References Cited

U.S. PATENT DOCUMENTS

| | | | | |
|---|---|---|---|---|
| 6,899,169 | B1 | 5/2005 | Cox | |
| 7,221,837 | B2 | 5/2007 | Mabry | |
| 7,243,711 | B2 | 7/2007 | Amstutz et al. | |
| 7,264,725 | B2 * | 9/2007 | Vido et al. | 210/321.88 |
| 2007/0267176 | A1 | 11/2007 | Song | |

* cited by examiner

COMPOSITE HEAT EXCHANGER END STRUCTURE

CROSS-REFERENCE TO RELATED APPLICATIONS

This application claims the benefit of U.S. Provisional Application No. 61/032,799, filed Feb. 29, 2008.

TECHNICAL FIELD

This patent disclosure relates generally to heat exchangers and, more particularly, to heat exchangers incorporating end structures of elastomeric character sealingly enclosing a heat exchanger adapted to provide flow reversal transition zones along the length of a tube bundle.

BACKGROUND

Heat exchangers may be used for a variety of applications and may encompass a number of different forms. By way of example only, oil coolers for internal combustion engines often take the form of an elongate housing which surrounds a tube bundle of substantially discrete heat exchange tubes. The tubes are often packed in a generally hexagonal pattern such that each tube is surrounded by up to six other tubes. Of course, other patterns may also be utilized. The tube bundle is installed through heat conducting fins and/or flow-directing baffles, and may be supported by the baffles and the conducting fins that are arranged in the housing to create a serpentine flow path between an inlet to the housing and an outlet.

Exemplary prior heat exchange devices are illustrated and described in U.S. Pat. No. 7,243,711 to Amstutz et al. having an issue date of Jul. 17, 2007. Embodiments of heat exchangers disclosed in this reference have a construction adapted to provide highly efficient cooling. In particular, this reference discloses a heat exchanger having a housing which defines a heat exchanging cavity within which a tube bundle is positioned. The tube bundle is made of a plurality of tubes arranged in a defined pattern. A disclosed embodiment utilizes an arrangement of baffles to support the tube bundle. The tube bundle, baffles and the housing define a serpentine flow path between an inlet and an outlet. The serpentine flow path includes a plurality of segments that are generally perpendicular to the tubes. These segments are separated by flow direction changing windows. At the flow direction changing windows, the tube bundle is separated from the housing by a gap distance which is relatively large. At positions removed from the flow direction changing windows, the tube bundle is separated from the housing by a substantially smaller gap distance. The ends of the housing are plugged by conventional techniques such as end structures of a resilient material surrounding the tubes of the tube bundle and extending to the housing. This arrangement is adapted to seal the heat exchange chamber against leakage when subjected to internal operating pressures. However, as internal pressures and/or gap distances are increased, sealing may become more difficult. Accordingly, a construction which provides support to the end structure within zones between the tube bundle and the housing while maintaining a good sealing relation is desirable.

SUMMARY

The disclosure describes, in one aspect, a heat exchanger. The heat exchanger includes a housing having an internal wall defining a portion of a heat exchanging cavity. A tube bundle including a plurality of tubes is disposed in the housing. At least one resilient end structure is disposed in compressed, plug-forming relation at least partially across the heat exchanging cavity in transverse relation to at least a portion of the tubes forming the tube bundle. The heat exchanger utilizes a serpentine flow path including a plurality of flow direction changing windows. The perimeter of the tube bundle is separated from the internal wall by a window distance at the flow direction changing windows. The resilient end structure includes at least one boundary segment extending between the internal wall and the perimeter of the tube bundle. The boundary segment includes at least a first zone formed from a first material characterized by a first compressive modulus of elasticity. The boundary segment also includes at least a second zone formed from a second material characterized by a second compressive modulus of elasticity. The second compressive modulus of elasticity is greater than said first compressive modulus of elasticity.

In another aspect, this disclosure describes a method of assembling a heat exchanger. The method includes providing a housing having an internal wall defining a portion of a heat exchanging cavity. The method further includes providing a tube bundle including a plurality of tubes and disposing the tube bundle within the housing. The housing is sealed with at least one resilient end structure disposed in compressed, plug-forming relation at least partially across the heat exchanging cavity in transverse relation to at least a portion of the tubes. The end structure includes at least one boundary segment disposed between the internal wall and the tube bundle. The boundary segment includes at least a first material of elastomeric character characterized by a first compressive modulus of elasticity in combination with at least a second material characterized by a second compressive modulus of elasticity. The second compressive modulus of elasticity is greater than the first compressive modulus of elasticity.

In another aspect, a containment unit is provided. The containment unit includes a structure including an opening. A sealing member is disposed within the opening. The sealing member includes an internal portion and at least one boundary segment. The boundary segment includes at least a first material of elastomeric character characterized by a first compressive modulus of elasticity in combination with at least a second material characterized by a second compressive modulus of elasticity. The second compressive modulus of elasticity is greater than said first compressive modulus of elasticity.

DETAILED DESCRIPTION

This disclosure relates to a heat exchanger having a tube bundle disposed within a housing with a resilient end structure disposed in compressed, plug-forming relation at least partially across the heat exchanging cavity. The resilient end structure includes one or more boundary segments extending between an internal wall of the housing and the perimeter of the tube bundle. The boundary segment includes a combination of materials having differing compression characteristics providing enhanced support to the boundary segments.

Figure 1:
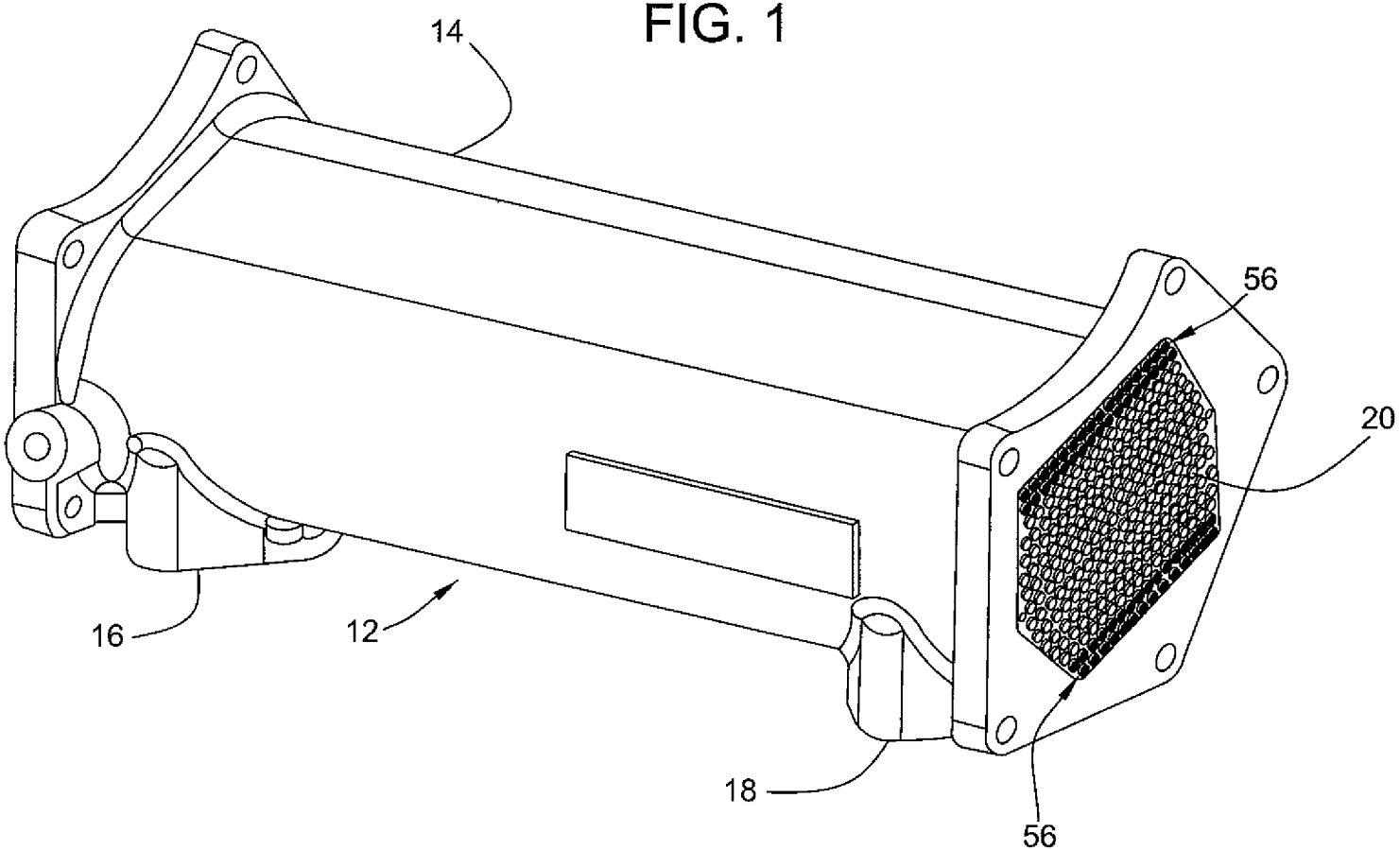
FIG. 1 is a schematic view illustrating an exemplary heat exchanger incorporating a multi-zone resilient end structure consistent with the present disclosure.

Reference will now be made to the drawings, wherein like reference numerals designate like elements in the various views. FIG. 1 illustrates an exemplary heat exchanger 12 such as an oil cooler or the like. In this regard, it is to be understood that while the heat exchanger 12 is illustrated in the form of an oil cooler such as may be used on an internal combustion engine, the heat exchanger 12 is in no way limited to such a configuration or use. Rather, the exemplary heat exchanger 12 consistent with this disclosure may take on many forms and be adapted to many applications as may be desired by a user.

In the exemplary construction, the heat exchanger 12 includes a structure or housing 14 with an inlet 16 and an outlet 18. Housing 14 may be made in any suitable manner using known materials. By way of example only, one suitable construction material may be cast aluminum which is machined to arrive at a final form. The housing 14 includes an inlet 16 and an outlet 18 for oil or other fluid to be cooled. A tube bundle 20 formed from a plurality of tubes 21 (FIG. 2) is mounted in a heat exchanging cavity defined by housing 14. The tubes 21 are formed from copper or other suitable heat conductive material and carry a coolant fluid in a manner as will be well known to those of skill in the art. In operation, hot oil or other fluid enters the heat exchanger 12 at inlet 16. The fluid then travels along tube bundle 20 and exits at a lower temperature at outlet 18.

Figure 2:
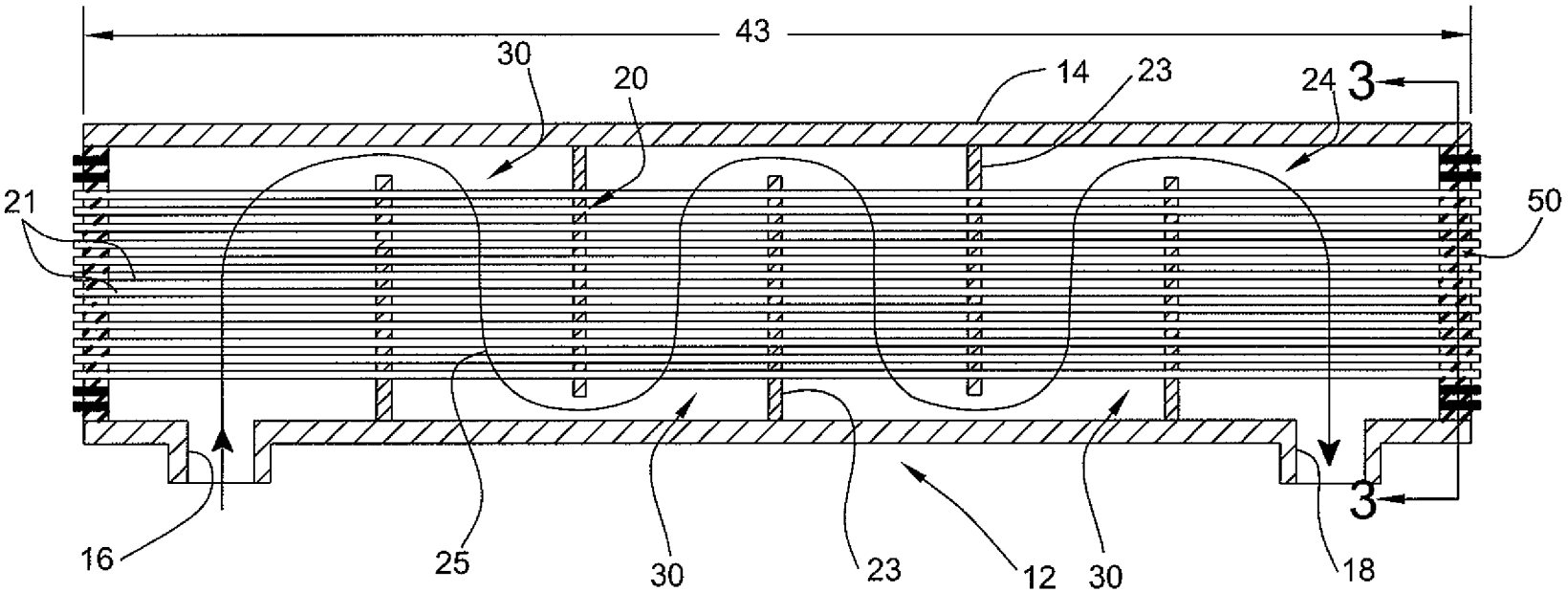
FIG. 2 is a cut-away schematic view illustrating the heat exchange cavity in the heat exchanger of FIG. 1.

As best seen in FIG. 2, in the exemplary construction baffles 23 are disposed at positions along the length of the housing 14. The baffles 23 surround portions of the tube bundle 20. The baffles 23 conform generally to the interior cross section of housing 14 and extend partially but not completely across the cavity defined by the housing 14. The baffles 23, tube bundle 20 and the housing 14 thus define a serpentine flow path 25 that begins at inlet 16 and ends at outlet 18. The serpentine flow path 25 includes segments that run roughly perpendicular to the tubes 21. These segments are separated by flow direction changing windows 30. Thus, the housing defines a heat exchanging cavity 24 within which the tube bundle 20 is positioned.

Figure 3:
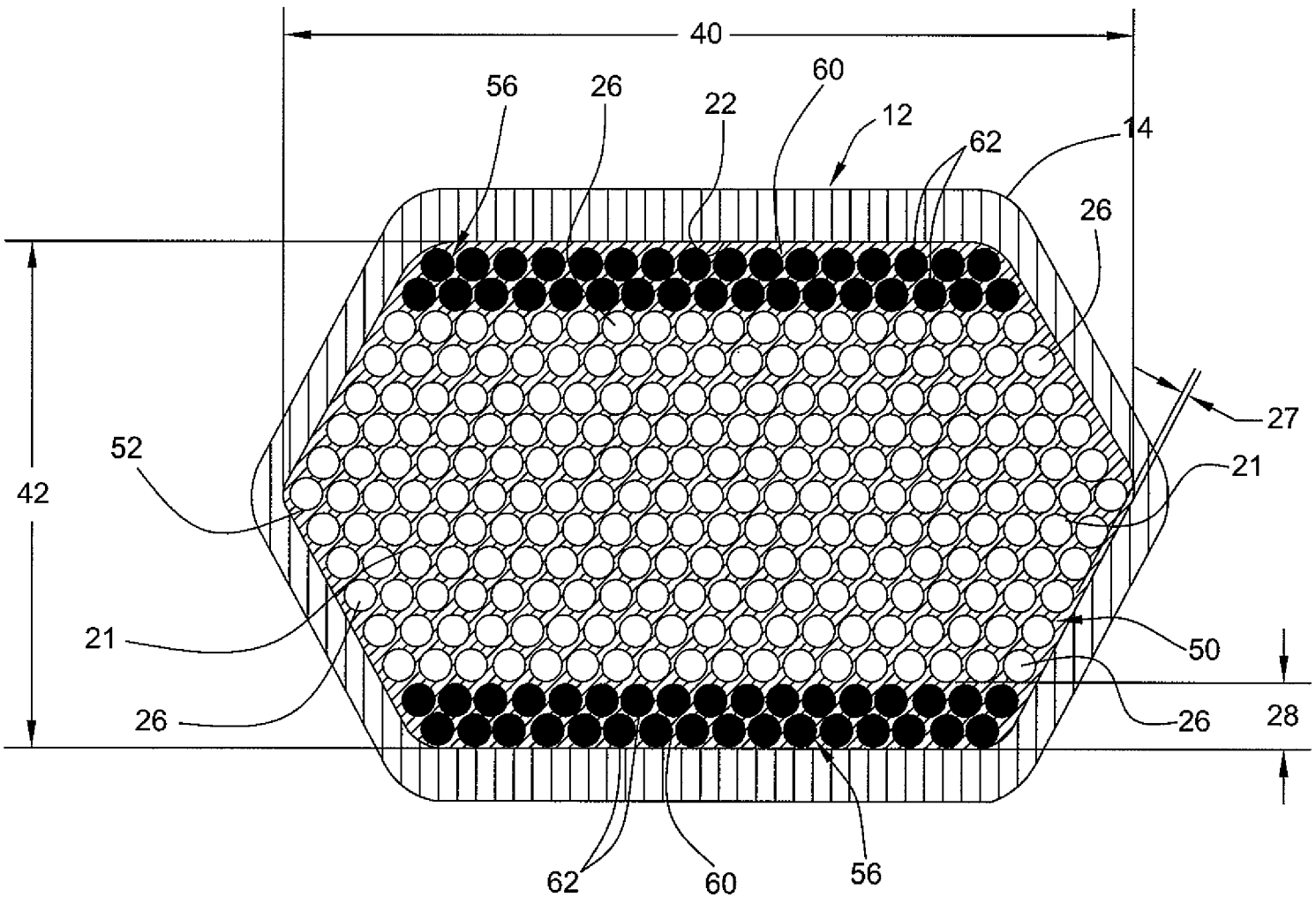
FIG. 3 is a schematic view taken generally along line 3-3 of FIG. 2 illustrating the multi-zone end structure of the heat exchanger of FIG. 1.

Referring jointly to FIGS. 2 and 3, housing 14 includes an internal wall 22 that is substantially uniform along its cavity length 43 (FIG. 2). Internal wall 22 has a shape sized to slideably receive tube bundle 20 and baffles 23. Thus, exemplary heat exchanging cavity 24 can be thought of as having a cavity length 43 with a uniform cross section having a cavity width 40 and a cavity height 42. The tube bundle 20 includes a perimeter set of tubes 26 that define a bundle perimeter that is separated from the internal wall 22 of housing 14 by a window distance 28 at the flow direction changing windows 30 and by a gap distance 27 away from the windows. The window distance 28 is generally greater than the gap distance 27. The gap distance 27 may be approximately the same as the spacing between tubes 26 within the tube bundle 20 although larger or smaller gap distances may also be used. In this regard, it is to be understood that the gap distance 27 need not be uniform and that at least some members of the perimeter set of tubes 26 may contact the internal wall 22. The window distance is such that a cross section of the serpentine flow path 25 at the flow direction changing windows 30 can accommodate flow without undue restriction thereby reducing pressure drop across heat exchanger 12 during operation. As will be appreciated, while the exemplary heat exchanger 12 and heat exchanging cavity 24 are shown as having a generally hexagonal cross section, any number of other configurations may likewise be used. By way of example only, such other configurations may include other polygonal shapes, circular shapes, oval shapes and the like.

As shown, heat exchanger 12 incorporates an exemplary end structure 50 of compressible character for use in sealing the heat exchanging cavity 24. The end structure 50 is disposed in compressed, plug-forming relation across the interior of housing 14. The illustrated exemplary end structure 50 includes a matrix of resilient material disposed in surrounding relation to the tubes 21 at an interior portion 52 of end structure 50. The matrix of resilient material includes portions inboard of the perimeter set of tubes 26. By way of example only, and not limitation, resilient materials forming the matrix may include elastomers such as, chloroprene, silicone, EPDM (ethylene propylene diene monomer), FKM (FKM flouroelastomers), polyurethane, HNBR (hydrogenated nitrile rubber) or the like. The illustrated exemplary end structure 50 also includes a pair of boundary segments 56 disposed between the tube bundle 20 and the internal wall 22 of housing 14. As shown, the boundary segments 56 are substantially axially aligned with the cross-sectional dimension of flow direction changing windows 30 such that the size and shape of the boundary segments 56 correspond generally to the cross-sectional configuration of flow direction changing windows 30. However, other geometries may likewise be used if desired. In this regard, it is to be understood that while the illustrated end structure 50 includes a pair of boundary segments 56, it is likewise contemplated that end structure 50 may include any number of boundary segments of varying shapes and sizes arranged at different positions around the tube bundle 2D.

Regardless of the location or shape of the boundary segments 56, it is contemplated that one or more of such boundary segments 56 will be a composite structure including zones characterized by different stiffness levels. In particular, at least one of the boundary segments 56 includes one or more reduced modulus zones 60 formed from a material such as an elastomer or the like characterized by a first compressive modulus of elasticity. The boundary segment 56 also includes one or more enhanced modulus zones 62 formed from a material characterized by a second compressive modulus of elasticity which is greater than that of the material forming the reduced modulus zones 60. As will be understood by those of skill in the art, a material with a higher compressive modulus is more rigid and provides greater resistance to elastic deformation under compressive loading conditions. Thus, at a comparable compression level, the reduced modulus zones 60 are susceptible to greater elastic deformation than the enhanced modulus zones 62. The enhanced modulus zones 62 may be substantially incompressible or may have limited compressibility relative to the reduced modulus zones 60. The reduced modulus zones 60 and the enhanced modulus zones 62 may be arranged in substantially adjacent relation to one another at positions across the boundary segment 56.

By way of example only, in the arrangement illustrated in FIG. 3, the reduced modulus zones 60 may be formed from an elastomeric material. The enhanced modulus zones 62 may be in the form of plugs inserted or molded in openings across the boundary segments 56 such that the reduced modulus zones 60 occupy the interstices between the plugs so as to substantially surround the plugs. The reduced modulus zones 60 extend to the internal wall 22 thereby forming a sealing relation between the end structure 50 and the housing 14. In the illustrated arrangement, the plugs are arranged in a pattern corresponding generally to the pattern of the tubes 21 in the tube bundle 20. However, any number of other arrangements may likewise be utilized. According to one contemplated practice, the reduced modulus zones 60 may be formed from the same elastomer as the matrix material surrounding the tubes 21 at the interior portion 52. However, other resilient materials may likewise be utilized if desired. It is also contemplated that the reduced modulus zones 60 may include two or more elastomers if desired. The plugs may be formed from any suitable material of enhanced compressive modulus relative to the reduced modulus zones 60. By way of example only, suitable plug material may include steel or other metals, elastomers of enhanced stiffness, wood, plastics, ceramics and the like. The plugs are maintained in place by the substantial compression forces applied to the end structure 50 although adhesive bonding and/or molding may also be used to maintain stability if desired.

Figure 4:
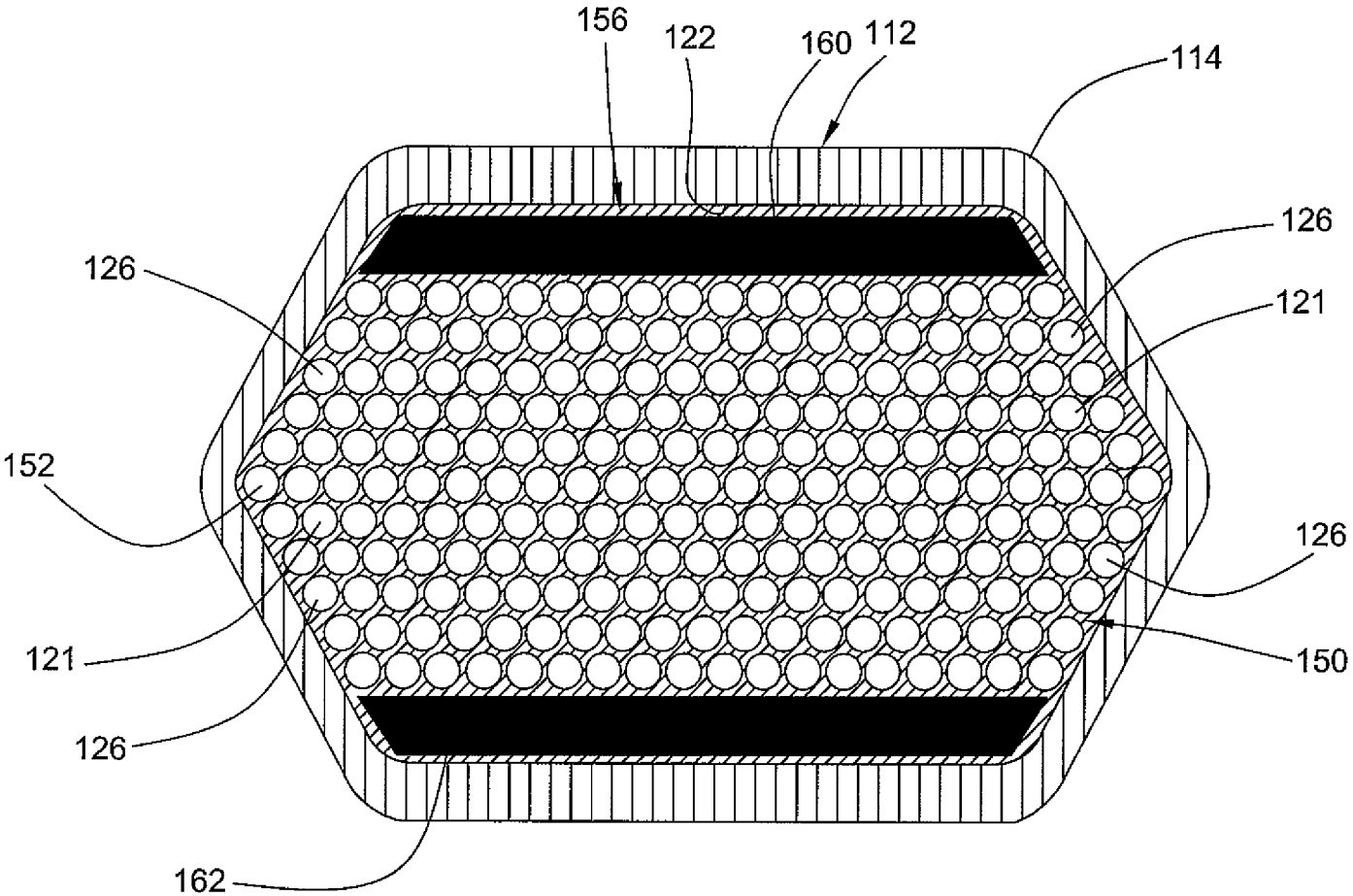
FIG. 4 is schematic view similar to FIG. 3 illustrating another multi-zone end structure construction.

It is also contemplated that any number of other arrangements may be utilized to provide a combination of substantially compressible zones and reduced compression zones across boundary segments of a heat exchanger end structure. By way of example only, FIG. 4 illustrates a construction for an end structure 150 held in compressed relation at the interior of housing 114. As will be appreciated, elements in FIG. 4 corresponding to those which have been previously enumerated are designated by like reference numerals within a 100 series. In the arrangement illustrated in FIG. 4, the enhanced modulus zones 162 are in the form of inserts positioned across the boundary segments 156. The reduced modulus zones 160 occupy the regions adjacent to the inserts and may substantially surround the inserts. In the illustrated arrangement, the inserts are generally trapezoidal in shape. However, any number of other arrangements may likewise be utilized. Moreover, while the illustrated arrangement utilizes single inserts to form the enhanced modulus zones 162, it is contemplated that multiple inserts may be used across the boundary segments 156 if desired. As shown, the reduced modulus zones 160 extend to the internal wall 122 thereby forming a sealing relation between the end structure 150 and the housing 114. The reduced modulus zones 160 may be formed from the same elastomer as the matrix surrounding tubes 121, although different elastomers may be used if desired. It is also contemplated that the reduced modulus zones 160 may include two or more elastomers if desired. The inserts may be formed from any suitable material of enhanced compressive modulus relative to the reduced modulus zones 160. By way of example only, such material may include elastomers of enhanced stiffness, metals, wood, plastics, ceramics and the like. The inserts are maintained in place by the substantial compression forces applied to the end structure 150 although adhesive bonding and/or molding may also be used to maintain stability if desired.

Figure 5:
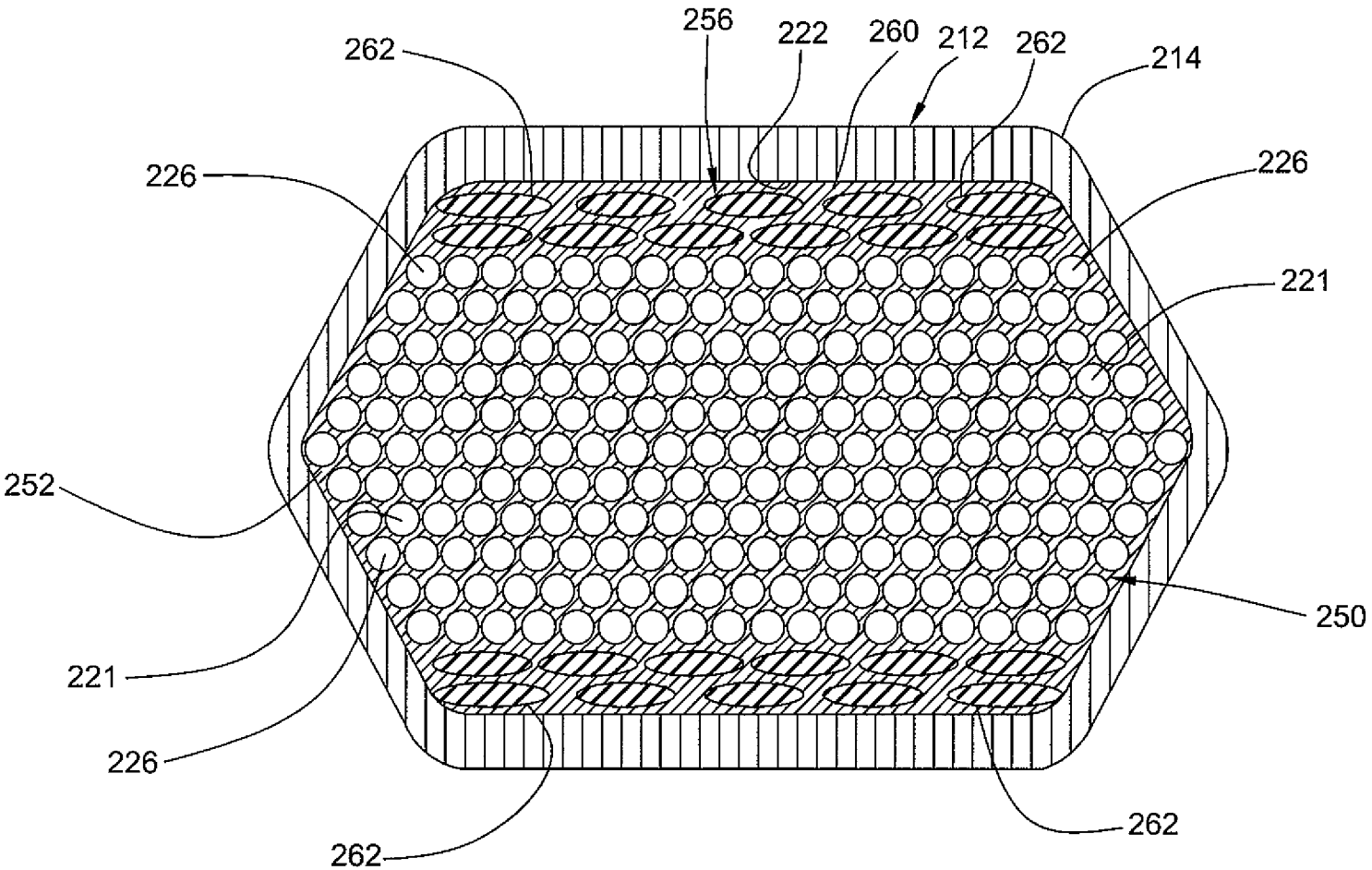
FIG. 5 is schematic view similar to FIG. 3 illustrating another multi-zone end structure construction.

FIG. 5 illustrates a construction for an end structure 250 held in compressed relation at the interior of housing 214. As will be appreciated, elements in FIG. 5 corresponding to those which have been previously enumerated are designated by like reference numerals within a 200 series. In the arrangement illustrated in FIG. 5, the enhanced modulus zones 262 are formed by selective chemical alteration or addition at defined locations across the boundary segments 256. The reduced modulus zones 260 occupy the regions adjacent to the enhanced modulus zones 262 and may substantially surround the enhanced modulus zones 262. In the illustrated arrangement, the enhanced modulus zones 262 are generally elliptical. However, any number of other arrangements may likewise be utilized. The reduced modulus zones 260 may extend to the internal wall 222 thereby forming a sealing relation between the end structure 250 and the housing 214. However, portions of the enhanced modulus zones 262 may also contact the internal wall 222 to establish part of the sealing interface if desired. The reduced modulus zones 260 may be formed from the same elastomer as the matrix surrounding the tubes 221, although different elastomers may be used if desired. It is also contemplated that the reduced modulus zones 260 may include two or more elastomers. By way of example only, according to one practice, the enhanced modulus zones 262 may be formed by the selective localized introduction of various fillers or other additives and/or by the selective introduction of cross-linking or other hardening agents into a base elastomer composition at localized positions across the boundary segments 256. Such agents increase localized stiffness thereby increasing the localized compressive modulus of elasticity.

It has been found that the presence of enhanced modulus zones at positions across boundary segments of a resilient end structure assists in supporting the boundary segments. This added support aids in the ability to extend the distance between a tube bundle and the housing and/or to increase the pressure within the heat exchanging cavity. Without being limited to a particular theory, it is theorized that the presence of the enhanced modulus zones at positions across the boundary segments facilitates enhanced uniformity of stress distribution across the end structure. The compressive forces applied by the surrounding housing are thus directed throughout the end structure thereby avoiding low compression regions and thus providing improved stability to the overall structure.

It is also contemplated that multi-zone sealing elements consistent with this disclosure may find application in environments other than heat exchangers. In this regard, such devices may find application as sealing structures in any number of pressurized or unpressurized containment units. By way of example only, such containment units may include various storage tanks, chemical reaction vessels and the like which require a good sealing relation across a structure opening.

INDUSTRIAL APPLICABILITY

The industrial applicability of a heat exchanger or other unit consistent with the present disclosure will be readily appreciated from the foregoing discussion. In this regard, the present disclosure relating to a heat exchanger applies to virtually any heat exchanging environment utilizing a tube bundle within a housing and incorporating a resilient sealing member with segments of the sealing member extending outboard from a perimeter of the tube bundle. Heat exchangers consistent with the present disclosure may be used to cool fluids such as water, oil, air or the like. Such heat exchangers may find particular application in environments where heat transfer is carried out using a serpentine flow path through the heat exchanger.

In practice, a heat exchanger consistent with this disclosure may be utilized in environments such as industrial equipment, on highway vehicles and the like where space is limited and where substantial cooling efficiency is required. In such environments, the use of a serpentine flow path through a housing incorporating relatively large flow direction changing windows may provide enhanced cooling efficiency. A resilient end structure may be used to effectively seal the heat exchanging cavity against leakage. Incorporating and or dispersing materials having relatively high levels of compressive modulus of elasticity within boundary segments of the resilient end structure provides enhanced stability while maintaining a compressive perimeter sealing relationship between the resilient end structure and the housing.

In addition to use within a heat exchanger, sealing elements consistent with this disclosure may find industrial application in virtually any structure requiring secure sealing across a large opening. This may include use in any storage or reaction structure where secure sealing is required.

What is claimed is:

1. A heat exchanger comprising:

a housing having an internal wall defining a portion of a heat exchanging cavity;

a tube bundle including a plurality of tubes disposed in said housing; and at least one resilient end structure disposed in compressed relation at least partially across said heat exchanging cavity in transverse relation to at least a portion of said plurality of tubes, said resilient end structure including an inner open surface disposed adjacent said heat exchanging cavity and an outer open surface opposite said heat exchanging cavity;

said at least one resilient end structure including at least one boundary segment disposed between said internal wall and said tube bundle, said at least one boundary segment including at least a first material of elastomeric character characterized by a first compressive modulus of elasticity in combination with at least a second material characterized by a second compressive modulus of elasticity, said second compressive modulus of elasticity being greater than said first compressive modulus of elasticity, wherein within a perimeter of said tube bundle and between said inner open surface and said outer open surface, said resilient end structure includes a single material, wherein said second material is separated from said housing and extends from one of the inner and outer open surfaces of said resilient end structure, said internal wall and said tube bundle define a serpentine flow path, said serpentine flow path including a plurality of flow direction changing windows, and said second material is disposed in said resilient end structure only within one or more portions of said resilient end structure aligned with said flow direction changing windows.

2. A heat exchanger as recited in claim 1, wherein said second material defines at least one enhanced modulus zone substantially surrounded by said first material of elastomeric character across said at least one boundary segment.

3. A heat exchanger as recited in claim 1, wherein said second material defines a plurality of enhanced modulus zones substantially surrounded by said first material of elastomeric character across said at least one boundary segment.

4. A heat exchanger as recited in claim 3, wherein said plurality of enhanced modulus zone includes a multiplicity of plug elements.

5. A heat exchanger as recited in claim 1, wherein said at least at least one boundary segment includes at least one enhanced modulus zone comprising an insert substantially surrounded by said first material of elastomeric character across said at least one boundary segment.

6. A heat exchanger as recited in claim 1, wherein said at least one boundary segment includes a plurality of enhanced modulus zones comprising selectively stiffened localized regions of said first material of elastomeric character, said selectively stiffened localized regions having enhanced stiffness.

7. A heat exchanger as recited in claim 6, wherein said first material of elastomeric character is an elastomer selected from the group consisting of chloroprene, silicone, ethylene propylene diene monomer, FKM flouroelastomers, polyurethane and hydrogenated nitrile rubber and wherein said selectively stiffened localized regions include at least one of enhanced filling and enhanced cross-linking relative to surrounding regions of said first material of elastomeric character.

8. A heat exchanger as recited in claim 1, wherein said first material of elastomeric character is an elastomer selected from the group consisting of chloroprene, silicone, ethylene propylene diene monomer, FKM flouroelastomers, polyurethane and hydrogenated nitrile rubber.

9. A heat exchanger as recited in claim 1, wherein said second material is selected from the group consisting of metals, elastomers, wood, plastics and ceramics.

10. A heat exchanger comprising:

a housing having an internal wall defining a portion of a heat exchanging cavity;

a tube bundle including a plurality of tubes disposed in said housing;

at least one resilient end structure disposed in compressed, plug-forming relation at least partially across said heat exchanging cavity in transverse relation to at least a portion of said plurality of tubes;

said internal wall and said tube bundle defining a serpentine flow path, said serpentine flow path including a plurality of flow direction changing windows;

said plurality of tubes including a perimeter set of tubes defining a perimeter of said tube bundle, said perimeter of said tube bundle being separated from said internal wall by a window distance at said flow direction changing windows, said at least one resilient end structure including an interior zone including at least a first material of elastomeric character characterized by a first compressive modulus of elasticity, at least a portion of said interior zone being disposed inboard of said perimeter of said tube bundle, said at least one resilient end structure further including a plurality of boundary segments disposed between said internal wall and said perimeter of said tube bundle, at least a portion of each of said flow direction changing windows being substantially axially aligned with at least one of said plurality of boundary segments, at least one of said plurality of boundary segments including said first material of elastomeric character in combination with at least a second material characterized by a second compressive modulus of elasticity, said second compressive modulus of elasticity being greater than said first compressive modulus of elasticity, said second material defining a plurality of enhanced modulus zones disposed in patterned relation with said first material of elastomeric character across said at least one of said plurality of boundary segments, wherein said second material is disposed in said resilient end structure only within one or more portions of said resilient end structure aligned with said flow direction changing windows.

11. A heat exchanger as recited in claim 10, wherein said plurality of enhanced modulus zones is substantially surrounded by said first material of elastomeric character across said at least one boundary segment.

12. A heat exchanger as recited in claim 11, wherein said plurality of enhanced modulus zones includes a multiplicity of plug elements.

13. A heat exchanger as recited in claim 10, wherein said plurality of enhanced modulus zones includes selectively stiffened localized regions of said first material of elastomeric character, said selectively stiffened localized regions having enhanced stiffness.

14. A heat exchanger as recited in claim 13, wherein said first material of elastomeric character is an elastomer selected from the group consisting of chloroprene, silicone, ethylene propylene diene monomer, FKM flouroelastomers, polyurethane and hydrogenated nitrile rubber and wherein said selectively stiffened localized regions include at least one of enhanced filling and enhanced cross-linking relative to surrounding regions of said first material of elastomeric character.

15. A heat exchanger as recited in claim 10, wherein said first material of elastomeric character is an elastomer selected from the group consisting of chloroprene, silicone, ethylene propylene diene monomer, FKM flouroelastomers, polyurethane and hydrogenated nitrile rubber.

16. A heat exchanger as recited in claim 10 wherein said second material is selected from the group consisting of metals, elastomers, wood, plastics and ceramics.

17. A containment unit comprising:

a structure including an opening; and a sealing member sealing said opening, said sealing member including a first open surface on one side thereof and a second open surface on an opposite side thereof;

said sealing member including an internal portion and at least one boundary segment, said at least one boundary segment including at least a first material of elastomeric character characterized by a first compressive modulus of elasticity in combination with at least a second material characterized by a second compressive modulus of elasticity, said second compressive modulus of elasticity being greater than said first compressive modulus of elasticity, wherein within said internal portion and between said first open surface and said second open surface, said sealing member includes a single material, said second material is separated from said structure and extends from one of the first and second open surfaces of said sealing member, said structure includes an internal wall and a tube bundle disposed within said structure, said internal wall and said tube bundle defining a serpentine flow path including at least one flow direction changing window, and said second material is disposed in said sealing member only within one or more portions of said sealing member aligned with said at least one flow direction changing window.

18. A method of assembling a heat exchanger comprising the steps of:

providing a housing having an internal wall defining a portion of a heat exchanging cavity;

providing a tube bundle including a plurality of tubes;

disposing said tube bundle within said housing;

sealing said housing with at least one resilient end structure disposed in compressed, plug-forming relation at least partially across said heat exchanging cavity in transverse relation to at least a portion of said plurality of tubes, said resilient end structure including an inner open surface disposed adjacent said heat exchanging cavity and an outer open surface opposite said heat exchanging cavity;

said at least one resilient end structure including at least one boundary segment disposed between said internal wall and said tube bundle, said at least one boundary segment including at least a first material of elastomeric character characterized by a first compressive modulus of elasticity in combination with at least a second material characterized by a second compressive modulus of elasticity, said second compressive modulus of elasticity being greater than said first compressive modulus of elasticity, wherein within a perimeter of said tube bundle and between said inner open surface and said outer open surface, said resilient end structure includes a single material;

wherein disposing said tube bundle within said housing includes disposing said tube bundle inside said housing in such a manner that said internal wall and said tube bundle define a serpentine flow path, said serpentine flow path including a plurality of flow direction changing windows; and wherein said second material is disposed in said resilient end structure only within one or more portions of said resilient end structure aligned with said flow direction changing windows.

19. The heat exchanger of claim 1, wherein said second material extends from said inner open surface of said resilient end structure to said outer open surface of said resilient end structure.

20. The heat exchanger of claim 1, wherein the one of the inner and outer open surfaces extends substantially perpendicular to the portion of said plurality of tubes.

21. A heat exchanger comprising:

a housing having an internal wall defining a portion of a heat exchanging cavity;

a tube bundle including a plurality of tubes disposed in said housing;

at least one resilient end structure disposed in compressed relation at least partially across said heat exchanging cavity in transverse relation to at least a portion of said plurality of tubes, said resilient end structure including an inner open surface disposed adjacent said heat exchanging cavity and an outer open surface opposite said heat exchanging cavity;

said at least one resilient end structure including at least one boundary segment disposed between said internal wall and said tube bundle, said at least one boundary segment including at least a first material of elastomeric character characterized by a first compressive modulus of elasticity in combination with at least a second material characterized by a second compressive modulus of elasticity, said second compressive modulus of elasticity being greater than said first compressive modulus of elasticity, wherein within a perimeter of said tube bundle and between said inner open surface and said outer open surface, said resilient end structure includes a single material, and wherein said internal wall and said tube bundle define a serpentine flow path, said serpentine flow path including a plurality of flow direction changing windows; and wherein said second material is disposed in said resilient end structure only within one or more portions of said resilient end structure aligned with said flow direction changing windows.

* * * * *